US008464456B2

(12) United States Patent
Pichler

(10) Patent No.: US 8,464,456 B2
(45) Date of Patent: Jun. 18, 2013

(54) COCKING AND UNCOCKING MECHANISM FOR A FIREARM

(75) Inventor: Harald Pichler, Gaflenz (AT)

(73) Assignee: STEYR MANNLICHER Holding GmbH, Kleinraming (AT)

( * ) Notice: Subject to any disclaimer, the term of this patent is extended or adjusted under 35 U.S.C. 154(b) by 13 days.

(21) Appl. No.: 13/378,876

(22) PCT Filed: May 6, 2010

(86) PCT No.: PCT/AT2010/000149

§ 371 (c)(1),
(2), (4) Date: Dec. 16, 2011

(87) PCT Pub. No.: WO2011/000002

PCT Pub. Date: Jan. 6, 2011

(65) Prior Publication Data

US 2012/0090450 A1 Apr. 19, 2012

(30) Foreign Application Priority Data

Jun. 30, 2009 (AT) ..... A 1019/2009

(51) Int. Cl.
*F41A 17/64* (2006.01)

(52) U.S. Cl.
USPC ..... 42/70.08; 42/69.01; 42/70.04

(58) Field of Classification Search
USPC ..... 42/70.01, 70.04, 70.05, 70.06, 70.08, 42/69.01–69.03
See application file for complete search history.

(56) References Cited

U.S. PATENT DOCUMENTS

| | | | | | |
|---|---|---|---|---|---|
| 461,182 | A | * | 10/1891 | Hollenbeck | 42/70.06 |
| 1,108,400 | A | * | 8/1914 | Savage | 42/21 |
| 3,735,519 | A | * | 5/1973 | Fox | 42/70.04 |
| 3,857,324 | A | * | 12/1974 | Tant | 89/197 |
| 3,949,508 | A | * | 4/1976 | Elkas | 42/69.03 |
| 4,270,295 | A | * | 6/1981 | Grehl | 42/70.08 |
| 4,926,574 | A | | 5/1990 | Rieger | |
| 5,465,518 | A | * | 11/1995 | Blaser | 42/70.08 |
| 5,625,971 | A | * | 5/1997 | Tuma et al. | 42/70.08 |
| 5,784,818 | A | * | 7/1998 | Otteson | 42/70.04 |
| 6,131,325 | A | * | 10/2000 | Kefer | 42/70.05 |

(Continued)

FOREIGN PATENT DOCUMENTS

| | | | |
|---|---|---|---|
| AT | 409548 | B | 9/2002 |
| DE | 4402951 | A1 | 8/1995 |

(Continued)

OTHER PUBLICATIONS

International Search Report for PCT/AT2010/000149 dated Jul. 23, 2010.

(Continued)

*Primary Examiner* — Bret Hayes
*Assistant Examiner* — Joshua Freeman
(74) *Attorney, Agent, or Firm* — Hoffmann & Baron, LLP

(57) ABSTRACT

The invention relates to a cocking and uncocking mechanism for a firearm, comprising a spring-loaded firing pin which, when in the cocked position, engages on a catch that can be released to fire, said catch being displaceable by an actuator element acting upon the catch via a link motion the control cam of which maintains the force to be applied to the actuator element to displace the catch to the cocked position substantially constant at least in the center region of the actuation path.

11 Claims, 4 Drawing Sheets

U.S. PATENT DOCUMENTS

| | | | | |
|---|---|---|---|---|
| 7,908,779 | B2 * | 3/2011 | Wasmer | 42/1.05 |
| 2006/0048428 | A1 * | 3/2006 | Thomele et al. | 42/70.08 |
| 2010/0229443 | A1 * | 9/2010 | Wasmer | 42/1.05 |

FOREIGN PATENT DOCUMENTS

| | | | |
|---|---|---|---|
| EP | 0312971 | A1 | 4/1989 |
| WO | WO9747940 | A1 | 12/1997 |
| WO | WO9963294 | | 12/1999 |

OTHER PUBLICATIONS

ISA Written Opinion for PCT/AT2010/000149 dated Apr. 30, 2011.
Austrian Official Action dated Mar. 17, 2010.
International Preliminary Report on Patentability dated Jan. 17, 2012.

* cited by examiner

COCKING AND UNCOCKING MECHANISM FOR A FIREARM

CROSS-REFERENCE TO RELATED APPLICATIONS

This application is a National Phase application of International Application No. PCT/AT2010/000149 filed May 6, 2010 which claims priority to Austrian Patent Application No. A 1019/2009 filed Jun. 30, 2009.

BACKGROUND

The present invention relates to a cocking and uncocking mechanism for a firearm with a spring-loaded firing pin that engages with a catch that can be released to fire in the cocked position, the catch being displaceable by an actuator element between the cocked position and a safety position uncocking the firing pin spring.

Such cocking and uncocking devices are used particularly for temporarily securing an already loaded weapon, e.g., for transport or while hunting. To leave the safety position, the catch must be recocked against the force of the firing pin spring, which is why such safety devices are simultaneously used as "handcocking systems."

In known designs (z.B. AT 409 548 B), the actuator element is connected to the catch by a lever linkage, with which the force for cocking the firing pin spring is exerted. This has the disadvantage that the force F to be exerted on the actuator element, corresponding to the spring characteristic of the firing pin, increases approximately linearly with the actuation length S, as illustrated in the diagram of FIG. 4. This renders usage of the actuator element, e.g., a cocking slide or wheel, extremely laborious. Moreover, the actuation force is greatest precisely in the area around the cocked position, which makes actuation of a catch or release device for engaging or disengaging the actuator element in the cocked position more difficult.

SUMMARY

The invention has the objective of creating a cocking and uncocking mechanism of the type mentioned above with easier operation. This objective is achieved according to the invention by virtue of the fact that the actuator element acts on the catch via a motion link, whose control cam holds the force to be exerted onto the actuator element to move the catch into the cocked position approximately constant in the central area of the actuation path.

In this manner, usage of the actuator element, e.g., a cockling slide or wheel, is considerably facilitated for the user. The transmission ratio of the lever linkage between the actuator element and the catch can be path-independently defined in advance with the aid of the motion link, specifically in such a manner that the actuation force remains largely constant for the user across the central section of the actuation path. After a slight build-up of actuation force to the level required for enabling easy initial movement, there is therefore no increasing difficulty, which allows a simplified and fast cocking process.

It is particularly favorable if, according to a preferred characteristic of the invention, the control cam reduces the force to be exerted onto the actuation element to shift the catch into the cocked position in the terminal area of the actuation path before the cocked position is reached. This can facilitate the operation of a catch or release element for locking or releasing the cocked position, because the actuator element need only be retained with a small exertion of force in this area. In addition, the cocking process can become carried out with much less noise than with known designs, because the cocked position can be reached with less exertion of force, almost "cautiously."

A preferred embodiment of the invention is distinguished in that the control cam is formed on the periphery of a pivoting crank driven by the actuator element and is sensed by a sensing linkage driving the catch, thus taking up only a small overall space.

It is particularly favorable if the sensing linkage is equipped with a preferably ball-bearing seated cam follower that rolls over the periphery of the control cam, whereby the friction of the motion link, and thus the required actuation force, can be considerably reduced.

The sensing linkage preferably engages with an auxiliary linkage guide of the motion link in order to keep the cam follower in contact with the control cam during the return motion to the safety position. Operating malfunctions due, for example, to increased friction from contamination and so forth can be avoided in this manner.

In another advantageous configuration of the invention, the sensing linkage comprises a linearly movable sensing rod that follows the control cam at one end and drives the catch at the other end, preferably via a housing-seated two-armed lever, which enables a particularly compact design with low space requirements.

The actuator element can be of any type known in the art, such as a cocking slide or a cocking wheel. The actuator element is preferably a cocking slide, which especially preferably locks in the cocked position and can be detached from the locking by means of a pushbutton. This known design of a cocking slide enables an operation and locking in the cocked position that are particularly immune to malfunctions and an easy transition into the safety position.

The cocking and uncocking mechanism of the invention is suitable for any type of firearm with a spring-loaded firing pin. The use of the invention is especially advantageous for semiautomatic weapons with a rotary piston action, and particularly for weapons whose firing pins have an attached firing pin tab that engages with the catch, because the cocking and uncocking mechanism of the invention can be mounted directly without additional parts.

BRIEF DESCRIPTION OF THE DRAWINGS

The invention will be explained in detail below with reference to an exemplary embodiment illustrated in the attached drawings. In the drawings:

FIGS. 1-3 show the rear part of a firing pin 1, a trigger mechanism 2, a cocking and uncocking mechanism 3 and (in part) a housing 4 of a firearm (not shown in further detail). The firing pin 1 acts on a cartridge in the chamber of a muzzle and is guided for this purpose in a rotary piston, which parts are known to those skilled in the art and are therefore not shown in detail here.

DETAILED DESCRIPTION

Figure 1:
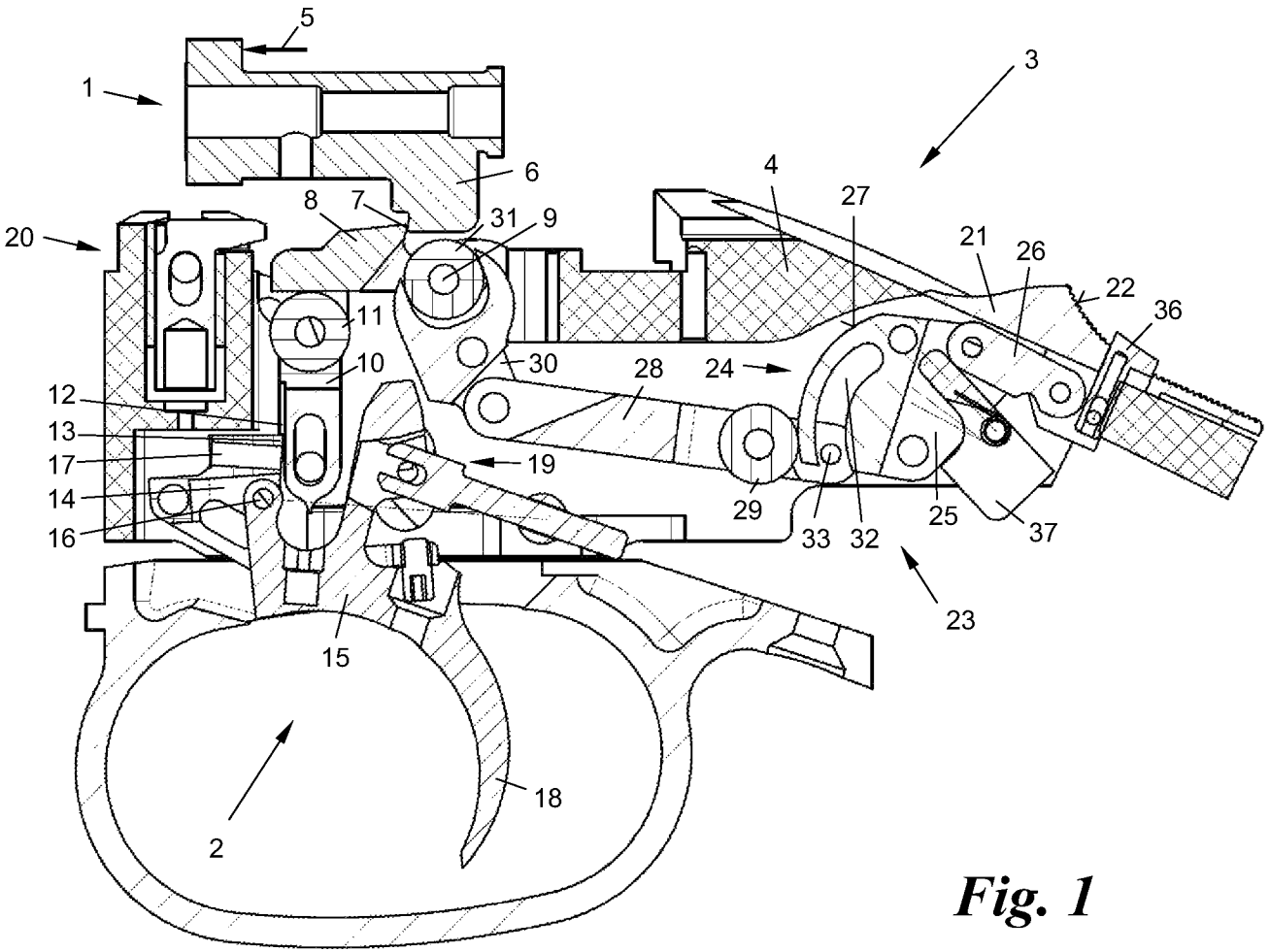
FIGS. 1-3 show the cocking and uncocking mechanism of the invention in cross-section in the safety position (FIG. 1), the cocked position (FIG. 2) and the position after firing (FIG. 3)

The firing pin 1 is subjected to a force to the left in the drawing by a firing pin spring 5 (indicated schematically) and is engaged with a firing pin tab 6 at 7 on a catch 8. The catch 8 is seated movably, in both the longitudinal and the transverse directions of the firing pin, by a bearing journal 9 in elongated holes of the housing 4. Thus the catch 8 can be released on the one hand to enable a shot by the firing pin 1 by means of the trigger mechanism 2, so that the firing pin moves to the left under the force of the firing pin spring 5 to strike the cartridge (see position after firing in FIG. 3); on the other hand the catch 8 can also be moved or displaced back and forth in the longitudinal direction of the firing pin between two different positions, specifically an unsecured or cocked position (FIG. 2), in which the catch holds the firing pin 1 cocked against the force of the firing pin spring 5 (in case of a rotary piston action, the firing pin 1 can also be brought into this position during the repeating or loading process by means of a conventional bolt handle); and an uncocked safety position (FIG. 1) in which the catch 8 is displaced to the left in the drawing in order to relieve the tension of the firing pin spring 5 (a slight residual tension can be left in the firing pin spring 5 in order to move the front part of the firing pin 1—not shown here—slightly away from the bottom of the cartridge).

In this respect, the catch 8 is a part of the trigger mechanism 2 as well as the cocking and uncocking mechanism 3.

To absorb the above-mentioned displacement motion of the catch 8, the trigger mechanism 2 comprises an intermediate element in the form of a catch rod 10 that is linearly guided in the housing 4 approximately vertically and supports a ball bearing-seated roller 11 at its upper end, on which the catch 8 can slide back and forth. The catch rod 10 in turn is engaged at a shoulder 12 on an engagement edge 13 formed on a shoulder 14 of a trigger 15. The trigger 15 is pivotably seated at 16 on the housing 4 and when actuated moves the engagement edge 13 away from the catch rod 10, so that the latter is moved downward (FIG. 3) and releases the catch 8 from the firing pin 1, whereby the shot is fired. The extent of the engagement overlap between the shoulder 12 of the catch rod 10 and the engagement edge 13 of the trigger 15 can be adjusted by means of an adjusting screw 17.

The trigger 15 with its engagement edge 13 can be integrally formed or—as shown—as two parts adjustable relative to one another, such as a first part comprising a trigger blade 18 and a second part comprising the shoulder 14 with the engagement edge 13. The trigger 15 can further be equipped with a drop guard 19 and a bolt catch 20 for triggering a rotary piston action, as known to those skilled in the art.

Figure 2:
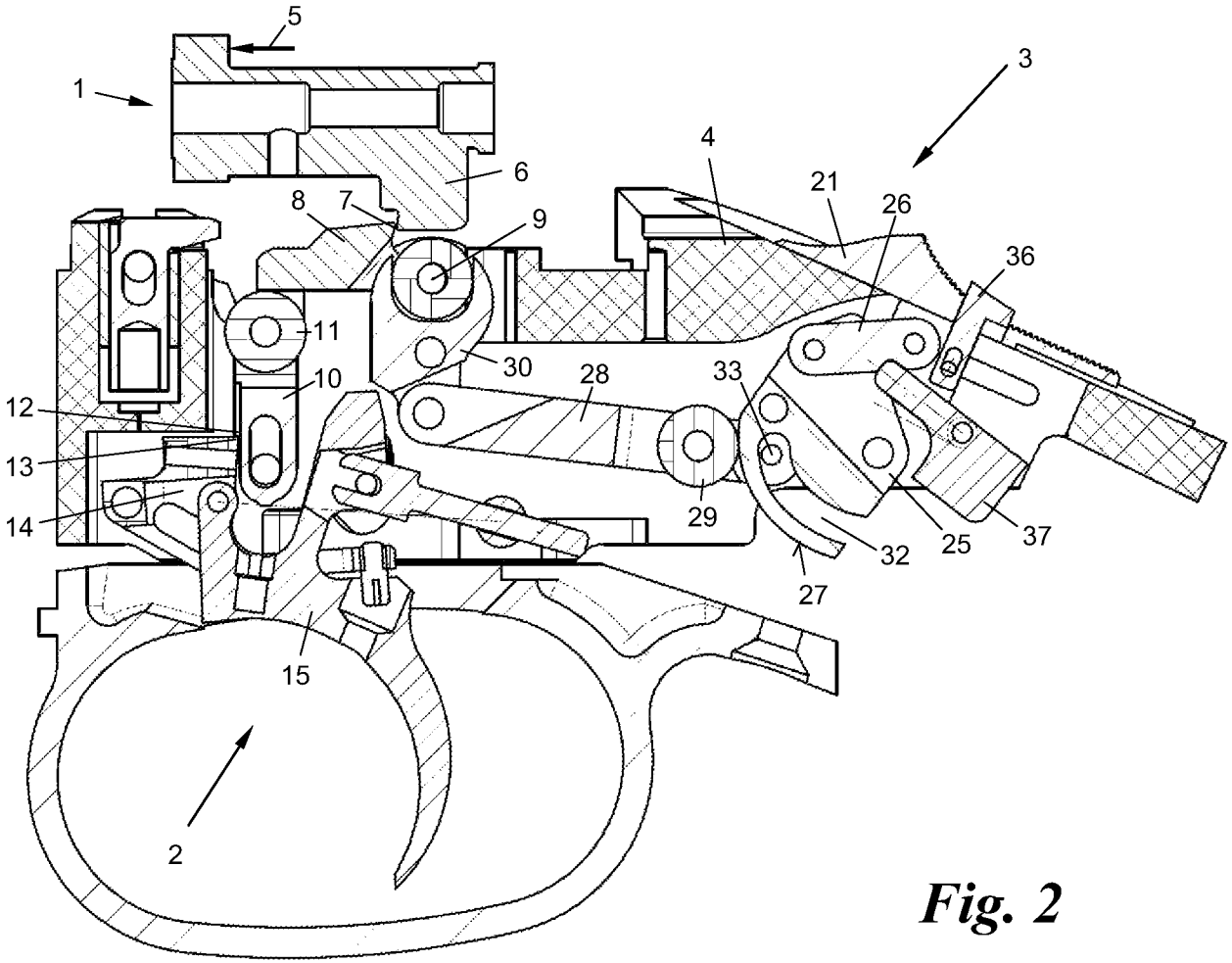
Figure 3:
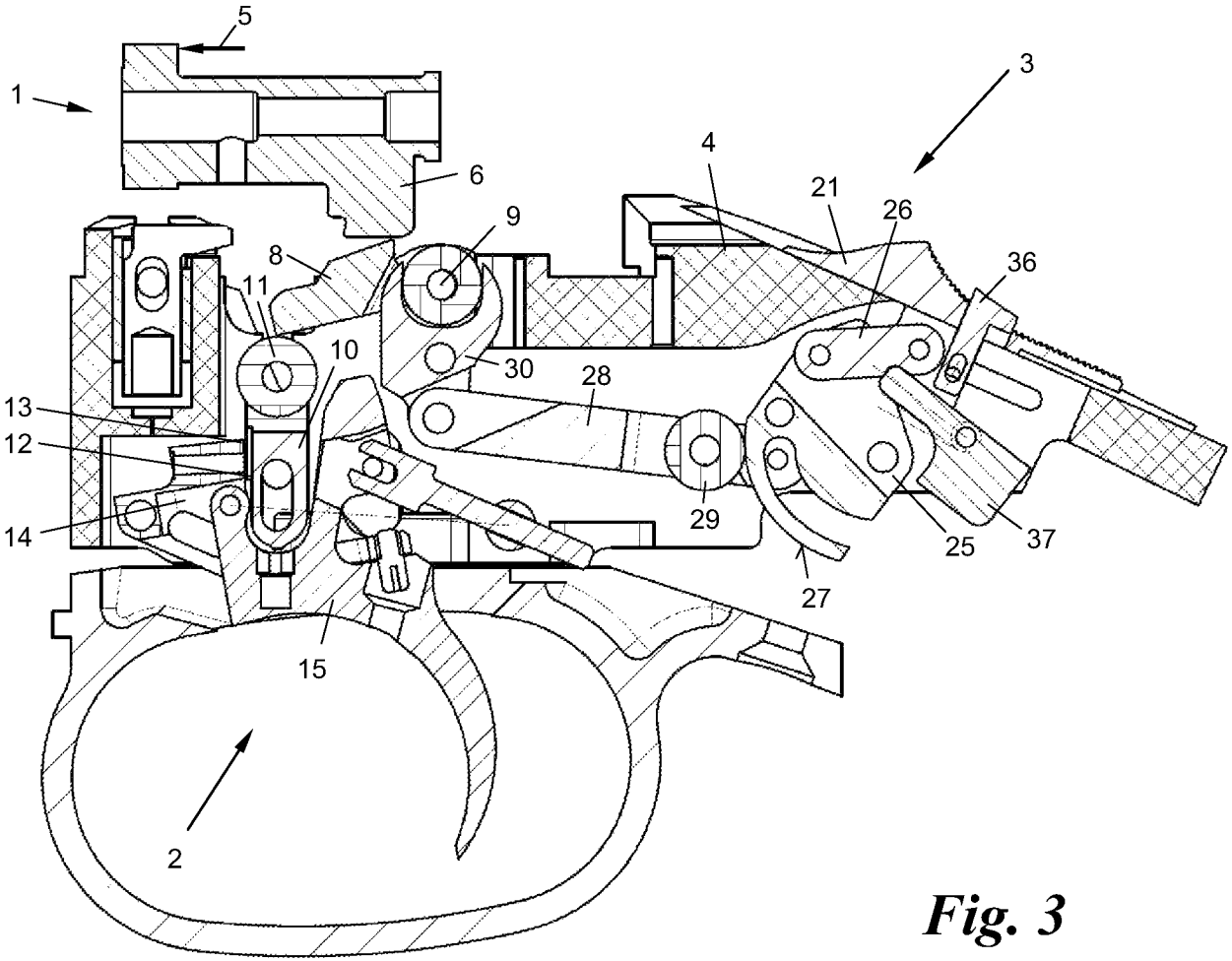
Figure 4:
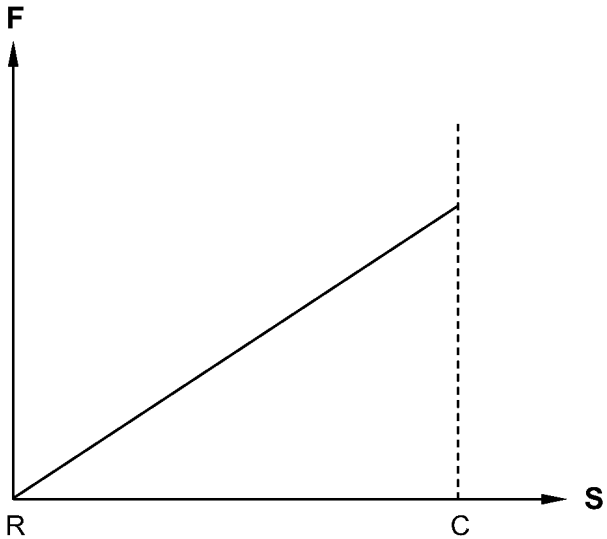
Fig. 4 (Prior Art)
FIGS. 4 and 5 show the force/distance diagram of a mechanism according to the prior art (FIG. 4) and a mechanism according to the invention (FIG. 5).

The cocking and uncocking mechanism 3 comprises an actuator element 21 in the form of a cocking slide 21 slidably seated on the outside of the housing 4 with a thumb-press surface 22, which acts via a linkage 23 on the catch 8 in order to move it back and forth in the longitudinal direction of the firing pin between its two positions (FIGS. 1 and 2). The linkage 23 contains a motion link 24, via which the force/distance transmission ratio between the actuator element 21 and catch 8 can be adjusted.

The motion link 24 comprises a pivoting crank 25 that can be pivoted by the cocking slide 21 via a connecting rod 26 and bears a control cam 27 on its outer periphery. A sensing linkage 28 with a ball bearing-seated cam follower 29 rolls over the control cam 27 and translates the shape of the control cam 27 into a movement of the catch 8 via a housing-seated two-armed lever 30 that engages with a pin 31 of the catch 8.

The pivoting crank 25 is also equipped with an auxiliary linkage guide 32 in the form of a groove guide that is located behind the control cam 27 and with which the sensing linkage 28 engages by means of a retaining pin 33 projecting past the cam follower 29. Thereby a forced contact of the cam follower 29 on the control cam 27 is assured in every operating state.

Figure 5:
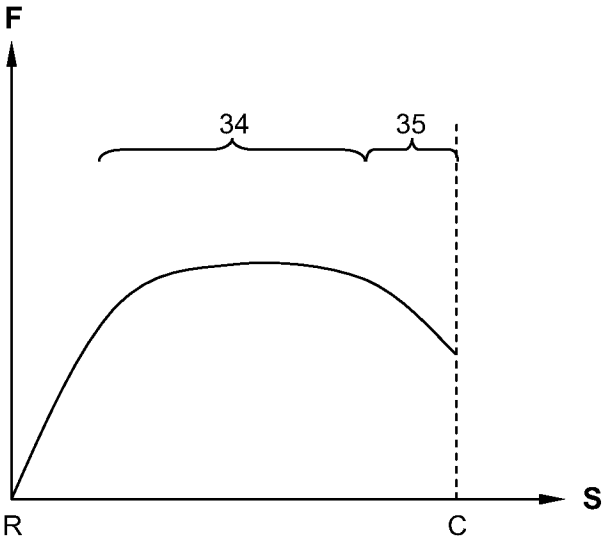

FIG. 5 shows the force/distance transmission ratio of the motion link 24, where R designates the uncocked or safety position of FIG. 1 and C designates the unsecured or cocked position of FIG. 2. When the cocking slide 21 is moved from R to C (from right to left in FIGS. 1 and 2), the pivoting crank 25 swings downward, the sensing link 28 slides to the left on the control cam 27 and the catch 8 is moved to the right by the lever 29 against the force of the firing pin spring 5. As is evident from FIG. 5, the slope of the control cam 27 is selected in such a manner that the force F to be exerted on the actuator element 21 is substantially constant at least in a central area 34 of the actuation path R-C of the cocking slide 21, in order to facilitate the operation of the cocking slide 21.

Optionally, the control cam 27 is preferably also selected in such a manner that the force F to be exerted diminishes further in the terminal area 35 of the actuation path R-C before the cocked position C. This enables a "cautious," soundless achievement of the cocked position C. It also facilitates the operation of a pushbutton 36 on the cocking slide 21 with which a self locking latch 37 for locking the connecting rod 26 in the cocked position C can be disengaged.

It is understood that, in place of the pivoting crank 25 as shown, any other motion link 23 fulfilling the above-mentioned transmission function can be used, such as a kinematic reversal with a control cam on the catch and a sensing linkage on the actuator element, etc. Furthermore, all rotary or pivot bearings in the mechanism can preferably be implemented by means of rolling contact bearings in order to reduce friction.

The invention is accordingly not limited to the illustrated embodiments, but instead comprises all variants and modifications that fall within the scope of the appended claims.

What is claimed is:

1. Cocking and uncocking mechanism for a firearm with a spring-loaded firing pin that engages in the cocked position with a catch that can be released to allow a shot, the catch being displaceable by an actuator element between the cocked position and a safety position relieving the tension of the firing pin spring, wherein the actuator element acts on the catch via a motion link having a control cam which maintains the force to be exerted on the actuator element in order to displace the catch into the cocked position substantially constant, at least in a central area of the actuation path.

2. Cocking and uncocking mechanism according to claim 1, wherein the control cam reduces the force to be exerted onto the actuator element to displace the catch into the cocked position in a terminal area of the actuation path before the cocked position is reached.

3. Cocking and uncocking mechanism according to claim 1, wherein the control cam is formed on the periphery of a pivoting crank driven by the actuator element and is sensed by a sensing linkage driving the catch.

4. Cocking and uncocking mechanism according to claim 3, wherein the sensing linkage is equipped with a ball bearing-seated cam follower that rolls over the control cam.

5. Cocking and uncocking mechanism according to claim 3, wherein the sensing linkage additionally engages with an auxiliary linkage guide of the motion link in order to hold the cam follower in contact with the control cam even during the return motion into the safety position.

6. Cocking and uncocking mechanism according to claim 3, wherein the sensing linkage comprises a linearly movable sensing rod that follows the control cam at one end and drives the catch at the other end.

7. Cocking and uncocking mechanism according to claim 6, wherein the linearly movable sensing rod comprises a housing-seated two-armed lever.

8. Cocking and uncocking mechanism according to claim 1, wherein the actuator element is a cocking slide.

9. Cocking and uncocking mechanism according to claim 8, wherein the cocking slide is locked in the cocked position and can be detached from the locked position by means of a pushbutton.

10. Cocking and uncocking mechanism according to claim 1, wherein the firearm is a semiautomatic weapon with a rotary piston action.

11. Cocking and uncocking mechanism according to claim 1, wherein the firing pin engages with the catch by means of an attached firing pin tab.

* * * * *